United States Patent [19]

Stoll

[11] Patent Number: 4,464,828

[45] Date of Patent: Aug. 14, 1984

[54] METHOD OF ASSEMBLING A CONTROL DEVICE

[75] Inventor: Donald H. Stoll, Morrison, Ill.

[73] Assignee: General Electric Company, Fort Wayne, Ind.

[21] Appl. No.: 420,986

[22] Filed: Sep. 21, 1982

Related U.S. Application Data

[62] Division of Ser. No. 244,021, Mar. 16, 1981, Pat. No. 4,410,776.

[51] Int. Cl.[3] ..... H01H 65/00

[52] U.S. Cl. ..... 29/622

[58] Field of Search ..... 29/622; 200/81 R, 83 P, 200/83 S, 83 SA, 159 B, 67 R, 67 D, 67 DA, 249, 250, 251, 284, 286, 159 A

[56] References Cited

U.S. PATENT DOCUMENTS

| | | | |
|---|---|---|---|
| 2,754,388 | 7/1956 | Beeman | 200/83 P |
| 2,755,362 | 7/1956 | Jacobs | 200/83 P |
| 2,906,132 | 9/1959 | Moody et al. | 200/83 P |
| 3,576,416 | 4/1971 | Good | 200/249 |
| 3,594,521 | 7/1971 | Roll | 200/67 D |
| 4,091,249 | 5/1978 | Huffman | 200/83 P |
| 4,214,136 | 7/1980 | Rossi et al. | 200/67 DA |
| 4,224,488 | 9/1980 | Rossi | 200/67 D |

*Primary Examiner*—Howard N. Goldberg
*Assistant Examiner*—P. W. Echols
*Attorney, Agent, or Firm*—Joseph E. Papin

[57] ABSTRACT

A method of assembling a control device. The control device has a housing, a first contact, a switch having a resilient switch blade with a second contact thereon, a pair of supports for the first contact and the switch and including at least one yieldable section, respectively, and an actuator for the switch to make and break the first and second contacts. In this method, the supports and the actuator are mounted with the pg,2 housing, and the second contact on the switch blade is engaged with the first contact. The at least one yieldable section of one of the supports is deformed, the first contact is thereby located in an adjusted position defining the magnitude of a force required to break the first and second contacts when the switch is actuated by the actuator. The at least one yieldable section of the other of the supports is deformed, and the resilient switch blade is thereby biased toward another adjusted position defining a differential between the magnitude of the first named force and that of another force required to make the first and second contacts when the switch is actuated by the actuator.

15 Claims, 3 Drawing Figures

METHOD OF ASSEMBLING A CONTROL DEVICE

CROSS-REFERENCE TO RELATED APPLICATION

This application is a division of parent application Ser. No. 244,021 filed Mar. 16, 1981, now U.S. Pat. No. 4,410,776.

FIELD OF THE INVENTION

This invention relates in general to controls which may be utilized in an automotive type air conditioning system or the like for instance and in particular to a method of assembling a control device for use in the system.

BACKGROUND OF THE INVENTION

In the past, various different types of prior art control devices, such as fluid pressure actuated switches for instance, were utilized in an automotive type air conditioning system to control the energization and deenergization of a clutch actuated compressor in such system in response to a low and high value of fluid pressure measured at a preselected point in such system, such as in an accummulator of such system for instance.

In some of these prior art control devices, a snap disc or Belleville type snap washer or the like for instance was utilized to effect the closing and opening of an electrical switch associated therewith in order to control the energization and deenergization of the clutch actuated compressor. The snap disc was translated from a stable configuration to an unstable configuration thereof in response to the occurrence of the aforementioned high value of the fluid pressure measured in the system, and in the unstable configuration, the snap disc drove a switch closed to complete a circuit energizing the clutch actuated compressor. Of course, the snap disc returned from its unstable configuration to its stable configuration in response to the occurrence of the aforementioned low value of the fluid pressure measured in the system, and the return of the snap disc to its stable configuration permitted the switch to open which interrupted the circuit effecting the deenergization of the clutch actuated compressor. Typically, a snap disc will translate between its stable and unstable configuration in response to a force differential which is built-in or preselected during the formation of the snap disc, and in at least some of these prior art control devices, the switch thereof may be adjustably loaded by a spring or the like in order to preselect the value of the force required for the snap disc to close the switch in response to the occurrence of the aforementioned high value of the fluid pressure measured in the system. However, at least one of the disadvantageous or undesirable features of the prior art control devices discussed above is believed to be that the "built-in" force differential of the snap disc is constant and can not be varied or adjusted. Further, it is also believed that the mechanical life of a snap disc may be limited due to the relatively high stresses which occur during the translatory movement of the snap disc between its stable and unstable configurations.

SUMMARY OF THE INVENTION

Among the several objects of the present invention may be noted the provision of an improved method of assembling a control device which overcomes the above discussed disadvantageous or undesirable features, as well as others, with respect to the prior art; the provision of such improved method utilizing a switch actuated between a pair of electrical states and having adjusting means for adjusting the force required to effect the actuation of the switch from one of the electrical states to the other thereof and for adjusting a force differential between such required force and another force required to effect the return of such switch to the one electrical state thereof; the provision of such improved method utilizing a pair of means for supporting the switch and contact means for making with the switch and breaking therefrom with the supporting means each having at least one deformable section which are deformable so as to define the aforementioned required force and force differential, respectively; and the provision of such improved method utilizing components which are simplistic in design, easily assembled and economically manufactured. These as well as other objects and advantageous features of the present invention will be in part apparent and in part pointed out hereinafter.

In general, a method is provided in one form of the invention for assembling a control device. The control device has a housing, a first contact, a switch having a resilient switch blade with a second contact thereon, a pair of means for supporting the first contact and the switch and including at least one yieldable section, respectively, and means for actuating the switch to make and break the first and second contacts. In this method, the supporting means and the actuating means are mounted to the housing, and the second contact on the switch blade is engaged with the first contact. The at least one yieldable section of one of the supporting means is deformed, and the first contact is thereby located in an adjusted position defining the magnitude of a force required to break the first and second contacts when the switch is actuated by the actuating means. The at least one yieldable section of the other of the supporting means is also deformed, and the resilient switch blade is biased thereby toward another adjusted position defining a differential between the magnitude of the first named force and that of another force required to make the first and second contacts when the switch is actuated by the actuating means.

BRIEF DESCRIPTION OF THE DRAWINGS

Corresponding reference characters indicate corresponding parts throughout the several views of the drawings.

The exemplifications set out herein illustrate a preferred embodiment of the present invention in one form thereof, and such exemplifications are not to be construed as limiting in any manner the scope of the present invention or the disclosure thereof.

DETAILED DESCRIPTION OF THE PREFERRED EMBODIMENT

Figure 1:
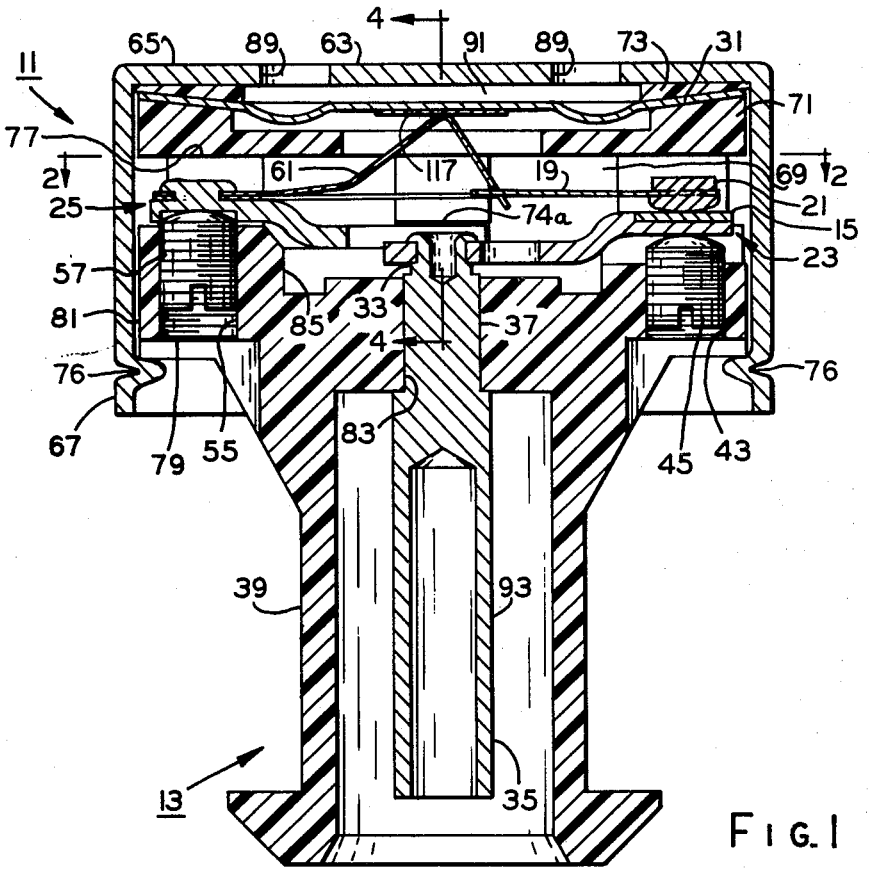
FIG. 1 is a sectional view showing a control device in cross-section and illustrating principles which may be utilized to practice a method of assembling a control device in one form of the invention.
Figure 2:
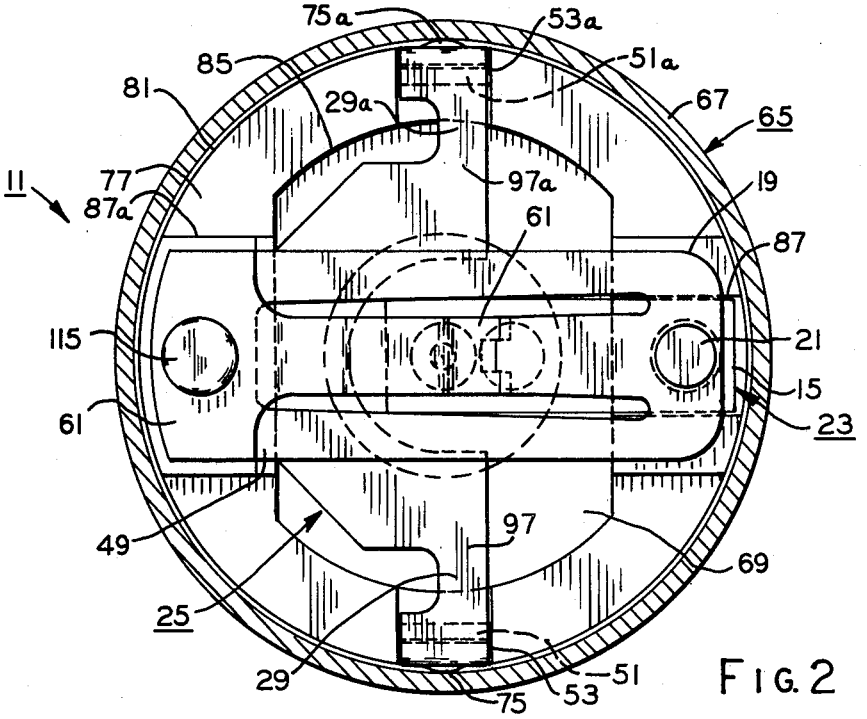
FIG. 2 is a sectional view taken along line 2—2 of FIG. 1.
Figure 3:
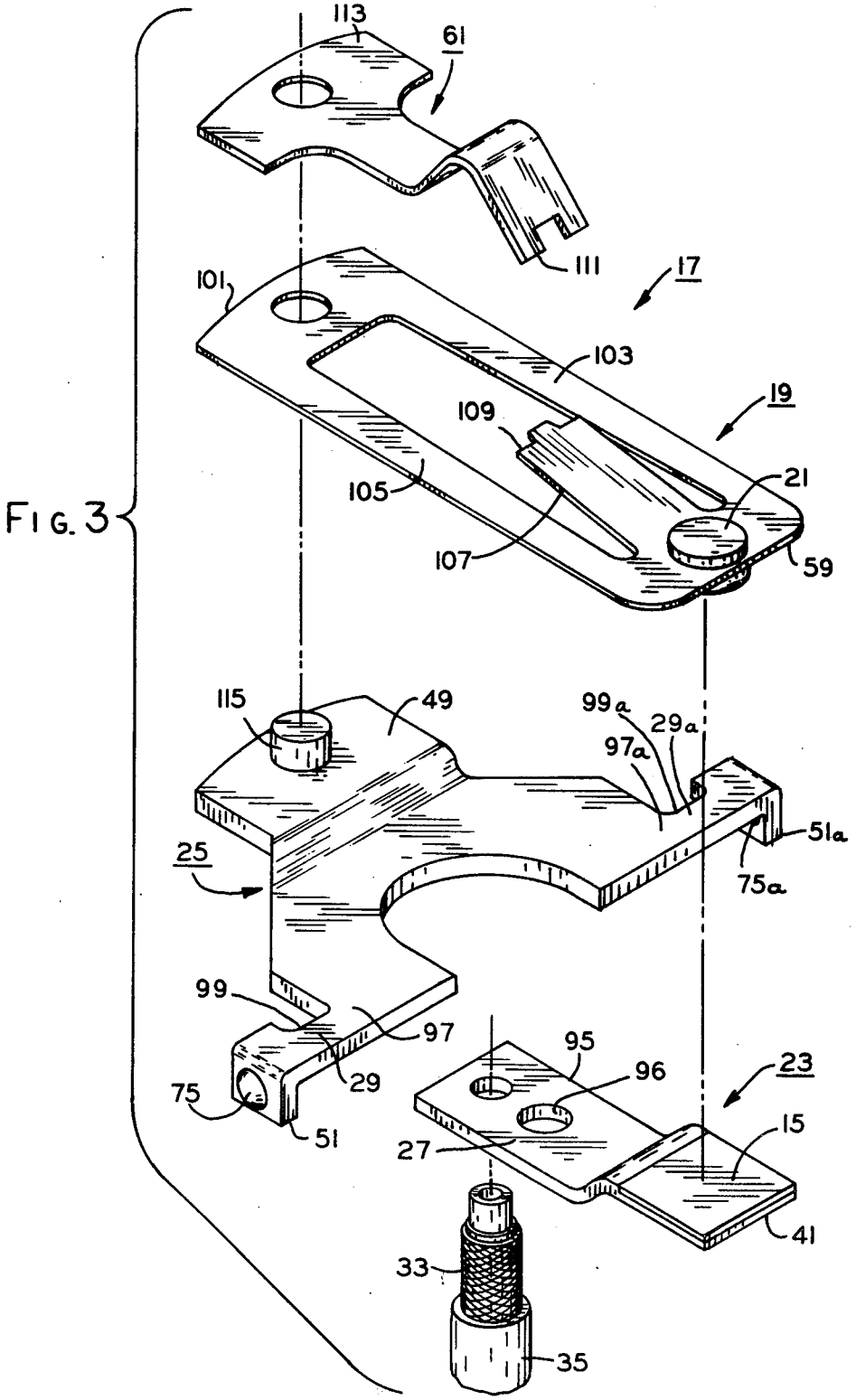
FIG. 3 is an exploded perspective view of a switch device, a contact and a pair of means for respectively supporting them as illustrated in the control device of FIG. 1.
Figure 4:
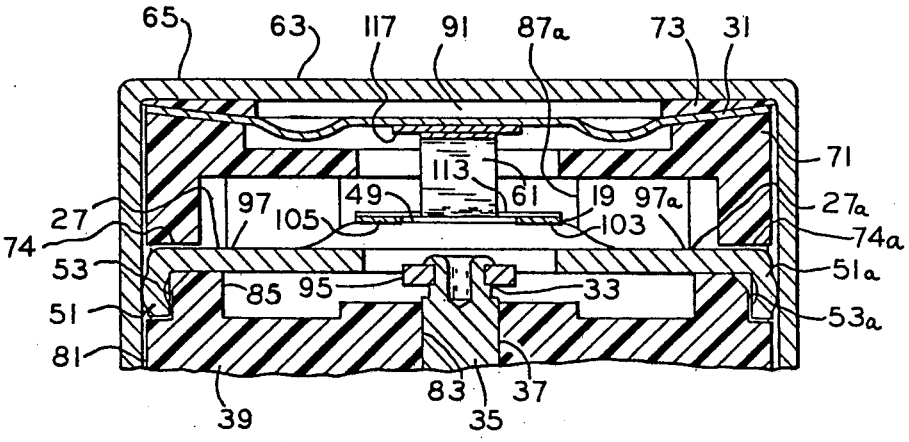

Referring now to the drawings in general, there is illustrated in one form of the invention a method of assembling a control device 11, such as a condition responsive or fluid pressure responsive electrical switch for instance (FIGS. 1–3). Control device 11 has a housing 13, a contact or contact means 15, and a switch or switch means 17 having a resilient, electrically conductive switch blade 19 with another contact or contact means 21 thereon (FIGS. 1 and 3). A pair of means, such as supporting members 23, 25 for instance, for supporting contact 15 and switch 17 include yieldable or deformable sections, as indicated at 27 and 29, 29*a*, respectively, and means, such as a diaphragm or diaphragm means 31 for instance, is provided for actuating the switch to make and break contacts 15, 21 (FIGS. 1 and 3). In this method, supporting means or members 23, 25 and actuating means or diaphragm 31 are mounted or otherwise secured or arranged in assembly positions to housing 13, and contact 21 on switch blade 19 is engaged or otherwise positioned so as to be made with contact 15 in electrically conductive relation. Deformable section 27 of supporting member 23 is permanently deformed or otherwise yielded, and contact 15 is thereby located or otherwise adjustably moved to an adjusted position defining the magnitude of a force F1 required to break contacts 15, 21 when switch 17 is actuated by diaphragm 31. Deformable sections 29, 29*a* of supporting member 25 are also permanently deformed or otherwise yielded, and switch blade 19 is thereby biased, urged or otherwise stressed into an adjusted position defining a differential between the magnitude of the aforementioned required force F1 and that of another force F2 required to make or remake contacts 15, 21 when switch 17 is actuated by diaphragm 31 (FIGS. 1–3).

More particularly and with specific reference to FIGS. 1–3, supporting member 23 is secured or otherwise assembled by suitable means, such as staking or welding or the like for instance, to a mounting section or end portion 33 of a terminal or terminal post 35, and the terminal post may be inserted or otherwise extended through a generally central opening 37 in a dielectric base 39 of housing 13. A free end portion 41 of the supporting member to which contact 15 is secured is disposed generally in overlaying relation with a threaded opening 43 in the base adapted for threadedly receiving an adjusting screw 45. Of course during the insertion of terminal post 35 into central opening 37 of base 39, as discussed above, the terminal post and base may be secured together against displacement by suitable means, such as a press fit or the like for instance; however, it is contemplated that the terminal post may be secured in its assembled position to the base against displacement by other suitable means well known to the art within the scope of the invention so as to meet the objects thereof.

Either before, after or simultaneously with the above mentioned assembly of supporting member 23 and terminal post 35 and the securement of the terminal post with base 39, switch 17 may be assembled or otherwise mounted generally in cantilever fashion to a bridge section 49 of supporting member 25 by suitable means, such as staking or welding for instance. Thereafter and subsequent to the above discussed securement of terminal post 35 with base 39, a pair of depending flanges or flange means 51, 51*a* spaced from deformable sections 29, 29*a* on supporting member 25 are inserted or otherwise placed into a pair of generally opposite recesses or recess means 53, 53*a* provided therefor in base 39. With flanges 51, 51*a* of supporting member 25 so inserted into base recesses 53, 53*a*, bridge section 49 of the supporting member is disposed or otherwise arranged generally in overlaying relation with another threaded opening 55 in base 39 adapted for threadedly receiving another adjusting screw 57. Upon the above discussed assembly of supporting member 25 with base 39, contact 21 which is mounted on a free end or end portion 59 of switch blade 19 is engaged or otherwise arranged in electrical contacting relation with contact 15 on supporting member 23.

Subsequent to the assembly of supporting means 25 with base 39, as discussed above, diaphragm 31 may be engaged or otherwise arranged in abutment with a snap-action toggle 61 of switch 17 and in sealing relation between an end wall 63 of an electrically conductive cover 65 and base 39 with a sidewall 67 of the cover extending generally about the base at least peripherally adjacent thereto so as to enclose supporting members 23, 25 and switch 17 within a chamber 69 defined between diaphragm 31, the base and the sidewall of the cover. Although diaphragm 31 is disclosed as being seated in sealing engagement between a pair of annular spacers 71, 73 which are, in turn, seated against base 39 and end wall 63 of cover 65, it is contemplated that the diaphragm may be sealably connected with the cover by suitable means, such as a peripheral weld bead or the like for instance, within the scope of the invention so as to meet at least some of the object thereof. With base 39 and cover 65 associated in assembly relation so that sidewall 67 of the cover extends generally about a confronting peripheral part of the base, as discussed above, a pair of opposite surfaces 74, 74*a* on spacer 71 are arranged generally in spaced and/or overlaying relation with flanges 51, 51*a* when received in recesses 53, 53*a* thereby to capture the flanges therein, and the cover sidewall is interconnected in electrical conductive relation with a pair of nodes or abutting projections 75, 75*a* or the like, for instance, provided on flanges 51, 51*a* of supporting member 25 captured in recesses 53, 53*a* of the base. When base 39 and cover 65 are arranged in assembly relation with each other, as discussed above, sidewall 63 of cover 65 is secured by suitable means, such as a plurality of crimps 76 or the like for instance, to the base against displacement therefrom. While crimps 76 are disclosed for interconnecting base 39 and cover 65 against displacement, it is contemplated that such interconnection may be accomplished by other suitable means known to the art within the scope of the invention so as to meet at least some of the objects thereof.

Upon the above discussed interconnection of base 39 and cover 65, adjusting screw 45 may be adjustably or threadedly moved in threaded opening 43 of base 39 into driving or adjusting engagement with free end 41 of supporting member 23 in response to a manually applied adjusting force exerted by an operator using a suitable tool, such as a screw driver or the like for instance (not shown), on the adjusting screw. This adjusting force exerted on adjusting screw 45 is effective to permanently deform free end 41 of supporting member 23 about deformable section 27 thereof so as to move or otherwise displace contact 15 toward the adjusted position thereof defining the magnitude or preselected value of the aforementioned required or preselected force F1 to break contacts 15, 21 when switch 17 is actuated by diaphragm 31. Either before, after or simultaneously with the above discussed adjustable movement of adjusting screw 45, adjusting screw 57 may be adjustably or threadedly moved in threaded opening 55 of base 39 into driving or adjusting engagement with bridge section 49 of supporting member 25 in response to another manually applied force exerted by an operator using a suitable tool, such as a screw driver or the like for instance (not shown), on the adjusting screw. This another adjusting force exerted on adjusting screw 57 is effective to permanently deform deformable sections 29, 29*a* of supporting member 25 generally about flanges 51, 51*a* captured in base recesses 53, 53*a*, and in response to such permanent deformation of deformable sections 29, 29*a* of the supporting member switch blade 19 is biased toward an adjusted position with contact 21 thereon engaged with contact 15 in its adjusted position thereby to define the differential between the aforementioned required or preselected force F1 and the aforementioned required or preselected force F2 to effect the making or remaking of contacts 15, 21 when switch 17 is actuated by diaphragm 31 as discussed in greater detail hereinafter.

With reference again in general to the drawings and recapitulating at least in part with respect to the foregoing, there is shown control device 11 having housing 13 with chamber 69 therein (FIG. 1). Contact 15 is adapted for adjustable disposition in chamber 69, and switch or switch means 17 is operable generally in the chamber for making with the contact and breaking therefrom (FIG. 1). Supporting member 25 is adapted for adjustable disposition in chamber 69 and for mounting switch or switch means 17 therein with respect to contact 15, and means, such as diaphragm 31 for instance, is movable in housing 13 and engaged with the switch for effecting its operation (FIGS. 1 and 3). Adjusting means or screw 45 is adjustably movable in housing 13 for adjusting the disposition of contact 15 with respect to switch 17 so as to adjustably establish preselected force F1 at which the switch breaks from contact 15 in response to the movement of the switch means operation effecting means or diaphragm 31 (FIG. 1). Adjusting means or screw 57 is adjustably movable in housing 13 for adjusting the disposition of supporting member 25 mounting switch 17 with respect to contact 15 to adjustably establish the differential between the preselected force F1 and preselected force F2 at which switch 17 makes with contact 15 in response to the movement of diaphragm 31 (FIG. 1).

More particularly and with specific reference to FIG. 1, control device 11 has a pair of housing members, such as base 39 and cover 65 for instance, and the base may be formed of any suitable dielectric material while the cover is formed from any suitable electrically conductive metallic material. Base 39 has a plurality of walls or wall means including a pair of opposite end walls 77, 79 interposed between a sidewall 81, and a pair of stepped bores or partial bores 83, 85 in the base intersect with the opposite end walls thereof, respectively, with the smaller stepped bore 83 comprising central opening 37. Opposite recesses 53, 53*a* are provided in end wall 77 of base 39, and a pair of generally opposite slots 87, 87*a* are also provided in end wall 77 of base 39 so as to communicate generally between larger stepped bore 85 and sidewall 81 of the base, respectively, with spacer 71 being seated on upper end wall 77 of the base. Threaded openings 43, 55 in base 39 extend between lower end wall 79 thereof and slots 87, 87*a*, and at least one pressure fluid passage or port 89 is provided through end wall 63 of cover 65 communicating with an expansible pressure fluid chamber 91 defined in the cover between diaphragm 31 and the cover end wall.

Terminal post 35 is secured in smaller stepped bore 83 of base 39 against displacement therefrom, as previously mentioned, and mounting section or end 33 of the terminal post extends into larger stepped bore 85 of the base while an electrical extension section 93 of the terminal post is exposed exteriorly of housing 13 for association with a quick-connect electrical fitting or coupling of a type known to the art (not shown). Supporting member or terminal extension 23 has an end or end portion 95 opposite free end 41 thereof which is secured to mounting section 33 of terminal post 35, and the free end of the terminal extension extends into slot 87 in spacer 73 into overlaying relation with threaded opening 43 in the base. It may be noted that a weakening opening 96 is provided through terminal extension 23 between mounted end 95 and free end 41 thereof so as to define deformable section 27 in the terminal extension; however, while weakening opening 96 is shown for purposes of disclosure, it is contemplated that other means, such as grooves, notches or other section reducing configurations or the like for instance, for defining deformable section 27 may be utilized within the scope of the invention so as to meet at least some of the objects thereof. When flanges 51, 51*a* of supporting member 25 are positioned in recesses 53, 53*a* therefor in base 39, as previously discussed, bridge section 49 of the supporting member extends into slot 87*a* of spacer 73 into overlaying relation with threaded opening 55, and a pair of arms 97, 97*a* are provided on the supporting member between the bridge section thereof and the flanges, respectively. It may be noted that arms 97, 97*a* are notched at 99, 99*a* thereby to define deformable sections 29, 29*a* in the arms at least generally adjacent flanges 51, 51*a*, respectively. While notches 99, 99*a* are illustrated herein for purposes of disclosure as being generally adjacent flanges 51, 51*a* for defining deformable sections 29, 29*a* in supporting member 35, it is contemplated that other means, such as openings, grooves or other section reducing configurations may be provided at any location in supporting member 35 spaced from flanges 51, 51*a* for defining such deformable sections within the scope of the invention so as to meet at least some of the objects thereof. Furthermore, it is also contemplated that arms 97, 97*a* may be provided with various shapes other than that disclosed herein for purposes of illustration within the scope of the invention so as to meet at least some of the objects thereof.

Switch blade 19 of switch 17 includes a mounting end 101 generally opposite free end 59 thereof, and a pair of spaced apart, generally planar legs 103, 105 are integrally formed between the mounting and free ends. A tongue 107 is integrally formed on free end 59 of switch blade 19 extending generally in a direction toward mounting end 101 thereof, and a pivot end 109 is provided on the tongue. Toggle or spring blade 61 has another pivot end 111 pivotally engaged with pivot end 109 of switch blade tongue 107 and another mounting end 113 generally opposite pivot end 111. Toggle mounting end 113 is arranged generally in overlaying relation in abutment with mounting end 101 of switch blade 19 on bridge section 49 or supporting member 25, and mounting ends 101, 113 are secured to the bridge section by suitable means, such as a rivet 115 or the like for instance, integrally formed with the bridge section. With toggle 61 so pivotally engaged with tongue 107 of switch blade 19, it may be noted that the toggle urges the switch blade in a direction so as to make contact 21 on switch blade free end 59 with contact 15 on terminal extension 23. Furthermore, it may also be noted that toggle 61 may be abutted with lubrication means, such as a piece of Teflon tape 117 or other lubricant or the like for instance if desired, for lubrication purposes on the underside of diaphragm 31 which, as previously mentioned, is movably mounted to cover 65 so as to be arranged in driving engagement with the toggle to effect the operation or actuation of switch 17. While switch 17 has been described and illustrated herein for the purposes of disclosure, it is contemplated that other switches having other configurations, component parts and different switching actions may be utilized within the scope of the invention so as to meet at least some of the objects thereof.

Operation

In the operation of control device 11, assume that deformable sections 27 and 29, 29*a* of terminal extension 23 and supporting member 25 have been permanently deformed, as previously discussed hereinbefore, and also assume that the control device is interconnected in an electrical circuit (not shown). Thus, with the component parts of control device 11 disposed as described above and as illustrated in the drawings, current may flow, in one direction for instance, through the control device from terminal post 35 through terminal extensions 23, closed contacts 15, 21 switch blade 19 and bridge 49, arms 97, 97*a*, flanges 51, 51*a* and nodes 75, 75*a* of supporting member 25 to cover 65.

In the event of the occurrence of a fluid pressure at control port 89 and in pressure fluid chamber 91 of control device 11, the fluid pressure acts on the effective area of diaphragm 31 to create force F1 acting to effect the displacement or driving movement of the diaphragm downwardly (as best seen in FIG. 1) against toggle 61 of switch 17. When the fluid pressure at control port 89 attains a magnitude increasing force F1 to the preselected value thereof, diaphragm 31 is driven against toggle 61 of switch 17 so as to pivotally move tongue 107 of switch blade 19 downwardly past the plane of switch blade legs 103, 105 which, of course, effects the snap-action movement of the switch blade in a direction breaking or disengaging its contact 21 from contact 15 of terminal extension 23 thereby to interrupt or break the electrical circuit through the control device. Upon the actuation of switch 17 to its switching state breaking its contact 21 from contact 15, contact 21 is abutted with spacer 71 thereby to limit the breaking movement of switch blade 19.

When the fluid pressure at control port 89 is reduced so as to correspondingly reduce force F1 by the preselected differential to another preselected value less than the preselected value at which switch 17 was actuated, diaphragm 31 moves upwardly (as best seen in FIG. 1) in response to such reduction of the fluid pressure at the control post thereby to effect the toggling snap-action return movement of switch blade 19 to its at-rest position remaking or reengaging its contact 21 with contact 15 on terminal extension 23. Thus, with contacts 15, 21 again made, the electrical circuit through control device 11 is once again completed.

From the foregoing, it is now apparent that a novel method of assembling a control device has been presented meeting the objects and advantageous features set out hereinbefore, as well as others, and that modifications as to the precise configurations, shapes, details and connections of the component parts of such control device, as well as the steps and order thereof of such assembling method, may be made by those having ordinary skill in the art without departing from the spirit of the invention or the scope thereof as set out by the claims which follow.

What I claim as new and desire to secure by Letters Patent of the United States is:

1. A method of assembling a control device having a dielectric base with a generally central opening therethrough, a pair of generally oppositely spaced recesses in the base, a pair of threaded openings in the base, a pair of adjusting screws threadedly received in the threaded openings, an electrical conductive cover having an end wall with at least one pressure fluid passage therein and a sidewall integral with the end wall, a terminal with a terminal extension secured thereto and with the terminal extension including a free end portion having a first contact thereon and a first deformable section at least generally adjacent the free end portion, a supporting member including a bridge section having a pair of generally oppositely extending arms thereon, a pair of depending flanges on the arms, respectively, and a pair of second deformable sections in the arms spaced from the flanges, respectively, a switch having a switch blade secured to the bridge section of the supporting member and also having a free end with a second contact thereon, a snap action toggle secured to the bridge section of the supporting member and pivotally arranged with the switch blade at least adjacent the free end thereof, and fluid pressure responsive diaphragm means for effecting the actuation of the switch to make the second contact with the first contact and break the second contact from the first contact, the method comprising the steps of:

extending the terminal through the generally central opening in the base with the free end portion of the terminal extension disposed generally in overlaying relation with one of the adjusting screws in the base and securing the terminal with the base;

inserting the depending flanges on the supporting member into the recesses in the base so as to capture the flanges therein with the bridge section on the supporting member disposed generally in overlaying relation with the other of the adjusting screws in the base and engaging the second contact on the free end of the switch blade with the first contact on the free end portion of the terminal extension;

associating the cover and the base in assembly relation with the sidewall of the cover extending generally about a confronting part of the base so as to enclose the switch, the terminal extension and the supporting member within a chamber formed between the diaphragm, the base and the sidewall of the cover with the diaphragm abutting the snap-action toggle of the switch and interconnecting the sidewall of the cover in electrical conductive relation with at least one of the depending flanges captured in one of the recesses of the base;

securing the sidewall of the cover to the base against displacement therefrom;

adjusting the one adjusting screw into engagement with the free end portion of the terminal extension so as to effect a permanent deformation of the first deformable section thereof and moving thereby the first contact toward a first adjusted position defining a preselected value of a force required to effect the breaking of the second contact from the first contact when the switch is actuated by the diaphragm means;

adjusting the other adjusting screw into engagement with the bridge section of the supporting member so as to effect a permanent deformation of the second deformable sections in the arms thereof and biasing thereby the switch blade toward a second adjusted position with the second contact engaging the first contact in its first adjusted position so as to define a differential between the first preselected force value and another preselected value of a force required to effect the remaking of the second contact with the first contact when the switch is actuated by the diaphragm means.

2. A method of assembling a control device having a base, a cover, a resilient switch element having a contact thereon, means for supporting another contact and having a deformable section, a supporting member including a bridge section with a pair of arms extending generally oppositely therefrom and with the resilient switch element secured to the bridge section so as to extend therefrom generally between the arms, and at least one of the arms having another deformable section therein, a pair of adjusting means arranged in the base for adjustable movement therein, and actuating means adapted for operating the resilient switch element to effect making and breaking of the first named contact thereon and the another contact on the supporting means, the method comprising the steps of:

securing the supporting means to the base and disposing a part of the supporting means generally in overlaying relation with one of the adjusting means in the base;

mounting the arms of the supporting member to the base, respectively, with the bridge section of the supporting member disposed generally in overlaying relation with the other of the adjusting means in the base and engaging the first named contact on the resilient switch element with the another contact on the supporting means, associating the cover in assembly relation with the base and arranging the actuating means in engagement with the resilient switch element;

adjustably moving the one adjusting means into engagement with the part of the supporting means effecting a permanent deformation of the first named deformable section of the supporting means and conjointly urging thereby the first named and another contacts against the resiliency of the resilient switch element to an adjusted position of the first named contact defining a preselected value of a force required to effect the breaking of the another contact from the first named contact when the resilient switch element is operated by the actuating means; and adjustably moving the other adjusting means into engagement with the bridge section of the supporting member effecting a permanent deformation of the another deformable section of the at least one arm and biasing thereby the resilient switch element toward another adjusted position with the first named contact thereon engaged with the another contact in its first named adjusted position so as to define the differential between the value of the first named force and the value of another force required to remake the another contact with the first named contact when the resilient switch element is operated by the actuating means.

3. A method of assembling a control device having a dielectric base, a pair of adjusting screws threadedly received in the base, a terminal having an extension with a first deformable section, a first contact on the terminal extension, an electrical conductive cover, a resilient switch element having a second contact thereon, actuating means adapted for operating the resilient switch element to effect making and breaking of the second contact thereon and the first contact on the terminal extension, an electrical conductive supporting member including a bridge section having a pair of generally opposite extending arms with a pair of second deformable sections therein and with the resilient switch element secured to the bridge section so as to extend therefrom generally between the opposite extending arms, the method comprising the steps of:

securing the terminal to the base and overlaying one of the adjusting screws in the base with the terminal extension;

disposing the opposite extending arms of the supporting member in mounting relation with the base with the bridge section of the supporting means arranged generally in overlaying relation with the other of the adjusting screws in the base and engaging the second contact on the resilient switch element with the first contact on the terminal extension; and associating the cover and the base in assembly relation so as to enclose therebetween the actuating means, the resilient switch element, the supporting member and the terminal extension with the actuating means engaging the resilient switch element and interconnecting the cover in electrical conductive relation with at least one of the opposite extending arms of the supporting member.

4. The method as set forth in claim 3 comprising the additional step of securing the cover and the base in the assembly relation thereof.

5. The method as set forth in claim 3 comprising the additional step of adjusting the one adjusting screw into engagement with the terminal extension so as to effect a permanent deformation of the first deformable section thereof and moving thereby the first contact toward a first adjusted position defining a preselected value of a force required to effect the breaking of the second contact from the first contact when the resilient switch element is operated by the actuating means.

6. The method as set forth in claim 5 comprising the further additional step of adjusting the other adjusting screw into engagement with the bridge section of the supporting member so as to effect a permanent deformation of the second deformable sections in the opposite extending arms of the supporting member and biasing thereby the resilient switch element toward a second adjusted position with the second contact engaging the first contact in its first adjusted position so as to define a differential between the first preselected force value and another preselected value of a force required to effect the remaking of the second contact with the first contact when the resilient switch element is operated by the actuating means.

7. The method as set forth in claim 3 wherein the opposite extending arms of the supporting member include a pair of flanges, respectively, and the base includes a pair of recesses therein, respectively, and wherein the disposing and engaging step includes positioning the flanges on the supporting member within the recesses in the base.

8. The method as set forth in claim 7 wherein the associating and interconnecting step includes abutting the cover in electrical conductive relation with at least a part of the flange on the at least one opposite extending arm of the support member.

9. The method as set forth in claim 3 wherein the base includes an opening therein and wherein the method includes the preliminary step of extending the terminal through the opening.

10. A method of assembling a control device having a base, a pair of adjusting means adapted for adjustable movement in the base, a terminal having an extension with a first permanently deformable section therein, a first contact on the terminal extension, a resilient switch element having a second contact thereon, and a supporting member including a bridge section having a pair of arms extending generally oppositely therefrom, a pair of second permanently deformable sections in the arms, and the resilient switch element being secured to the bridge section so as to extend therefrom generally between the arms, respectively, the method comprising the steps of:

placing the terminal extension with respect to the base and generally in overlaying relation with one of the adjusting means in the base;

disposing the arms of the supporting member in mounting relation with the base with the bridge section of the supporting means arranged generally in overlaying relation with the other of the adjusting means in the base and making the second contact on the resilient switch element with the first contact on the terminal extension;

adjusting the one adjusting means in the base with respect to the terminal extension so as to effect a permanent deformation of the first permanently deformable section thereof and moving thereby the first contact toward a first adjusted position defining a preselected value of a force required to operate the resilient switch element and break the second contact thereon from the first contact in the first adjusted position thereof; and adjusting the other adjusting means in the base with respect to the bridge section of the supporting member so as to effect a permanent deformation of the second permanently deformable sections in the arms of the supporting member and biasing thereby the resilient switch element toward a second adjusted position with the second contact made with the first contact in the first adjusted position thereof so as to define a differential between the first preselected force value and another preselected value of a force required to operate the resilient switch element and remake the second contact thereon with the first contact.

11. The method as set forth in claim 10 wherein the control device has a cover and actuating means adapted for operating the resilient switch element to effect the making and breaking of the second contact thereon with the first contact on the terminal extension, and comprising the intermediate step of associating the cover in assembly relation with the base so as to enclose therebetween the actuating means, the resilient switch element, the supporting member and the terminal extension and engaging the actuating means with the resilient switch element.

12. The method as set forth in claim 11 wherein the base is formed of a dielectric material and the cover is formed of an electrical conductive material, and wherein the associating and engaging step includes contacting the cover in electrical conductive relation with at least a part of at least one of the arms of the supporting member.

13. The method as set forth in claim 11 comprising the further intermediate step of securing the cover and the base in their assembly relation.

14. The method as set forth in claim 10 wherein the arms of the supporting means include a pair of flanges, and the base includes a pair of recesses, and wherein the disposing and making step includes capturing the flanges in the recesses, respectively.

15. The method as set forth in claim 10 wherein the placing step includes associating the terminal in mounting relation with the base.

* * * * *